United States Patent [19]

Echols et al.

[11] Patent Number: 4,473,322

[45] Date of Patent: Sep. 25, 1984

[54] METHOD AND SYSTEM FOR LINING SHAFTS

[76] Inventors: H. Vance Echols, 815 N. Glenmere Way, Los Angeles, Calif. 90049; Eugene A. Mills, 15904 Arbela Dr., Whittier, Calif. 90603

[21] Appl. No.: 36,961

[22] Filed: May 7, 1979

[51] Int. Cl.[3] ..... E21D 9/00; E21D 11/00

[52] U.S. Cl. ..... 405/133; 405/151

[58] Field of Search ..... 405/146, 147, 151, 152, 405/153, 133, 134, 135–138, 141–145, 150

[56] References Cited

U.S. PATENT DOCUMENTS

| | | | |
|---|---|---|---|
| 794,634 | 7/1905 | Moir | 405/147 |
| 1,296,312 | 3/1919 | O'Rourke | 405/147 |
| 2,667,750 | 2/1954 | Bain | 405/133 |
| 3,074,237 | 1/1963 | Lilly | 405/133 |
| 3,266,257 | 8/1966 | Larrouze et al. | 405/146 X |
| 3,640,076 | 2/1972 | Rees et al. | 405/146 |
| 3,768,267 | 10/1973 | Chlumecky | 405/152 |
| 3,818,710 | 6/1974 | Chlumecky | 405/153 X |
| 4,003,211 | 1/1977 | Klapdor et al. | 405/147 X |
| 4,270,876 | 6/1981 | Eklund et al. | 405/133 |

FOREIGN PATENT DOCUMENTS

| | | | |
|---|---|---|---|
| 499823 | 4/1976 | U.S.S.R. | 405/146 |

*Primary Examiner*—Dennis L. Taylor

[57] ABSTRACT

A method and system for lining shafts such as mining shafts, comprising precasting lining panels and placing them in the shaft, assembling them to form a lining section, then filling the void behind the precast lining panels to secure the lining in place. Subsequent lining panels are passed down through previous liner sections, assembled and positioned around the walls of the shaft and temporarily secured. The void behind these sections is then filled to set the liner section. The precast panels are provided with hangers for temporarily hanging subsequent sections and also are provided with apertures or doors for pouring grouting to fill the void behind the panels after they are positioned. Each panel is also provided with a joint for mating with adjacent panels which permits checking the panel sections before placement and assembly into a lining section. The system also includes the use of an inflatable ring at the bottom of each liner section after the panels have been fitted together for pouring a curb ring to plug the space between the bottom of the liner section and the shaft wall. The void behind the panels can then be filled setting the liner section.

17 Claims, 8 Drawing Figures

FIG. 1
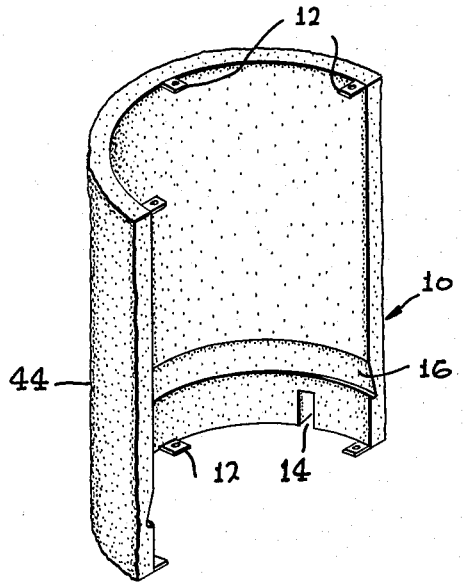
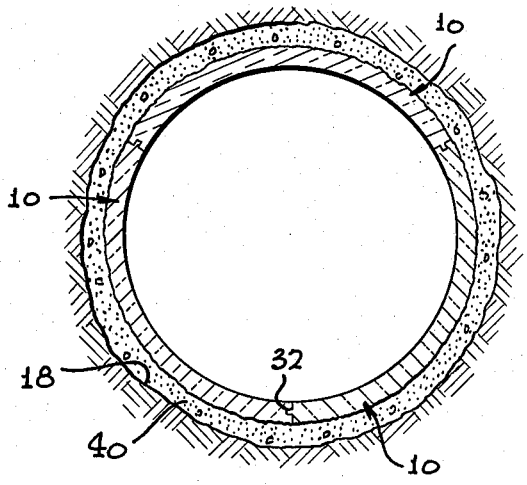
FIG. 5
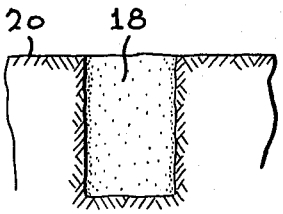
FIG. 2
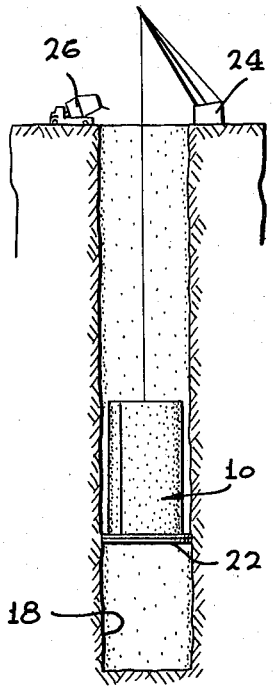
FIG. 3
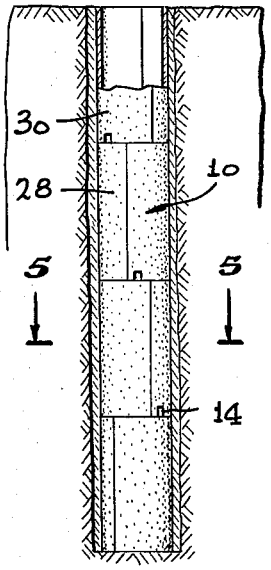
FIG. 4

FIG. 6
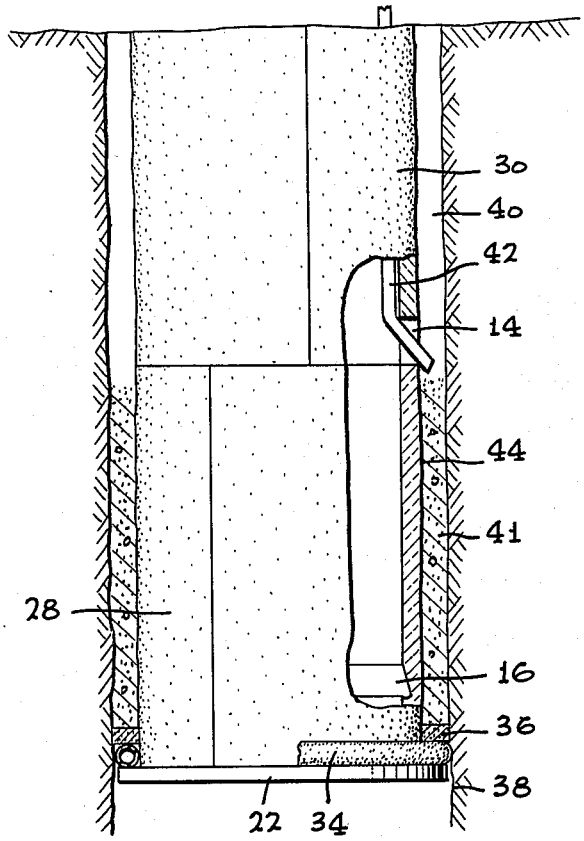
FIG. 7
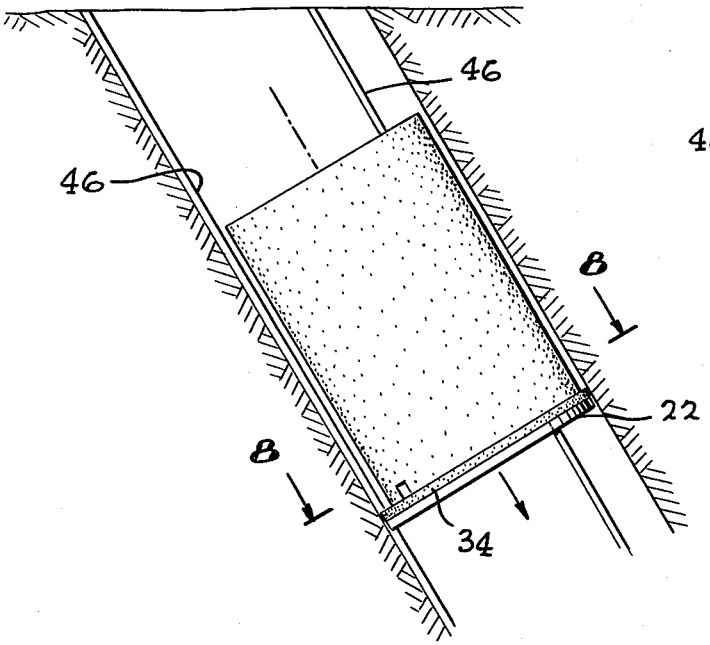
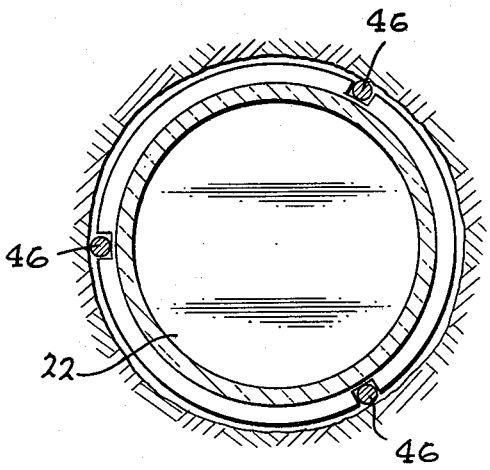
FIG. 8

METHOD AND SYSTEM FOR LINING SHAFTS

BACKGROUND OF THE INVENTION

This invention relates to method and systems for lining shafts such as mining shafts, and more particularly relates to a system utilizing precast liner panels.

Shafts or tunnels bored into the earth are used for a variety of purposes. For example, mining shafts are used for the production and transportation of men and materials or mine ventilation from the surface. Internal raises or winzes are used for the passage of water, waste, or men and materials within a mine. Construction shafts are also used for ventilation in transportation tunnels, water passageways, etc., and may be vertical or inclined. These tunnels or shafts are conventionally constructed by drilling, blasting, mucking or by drilling (boring).

Most of the shafts constructed today are circular in cross-section and lined with concrete. The concrete lining provides protection from weathering for the wall rock. The smooth passage for ventilation air also provides structural integrity for the tunnel and permits ground water control.

In the present system of constructing and lining shafts, the placement of concrete is time-consuming and expensive as it normally interrupts the construction of the shaft. Various types of wood and metal forms are lowered into place below the last-lined portion of the shaft and braced into place and concrete filled in behind the forms between the forms and the wall rock. Frequently much time is lost waiting for the concrete to cure and strengthen before the forms may be stripped and removed out of the way. Drilling and construction may then proceed with subsequent sections lined with concrete by again placing the forms and filling with concrete. As can be perceived, this can be extremely time-consuming and expensive.

With the present invention, it is proposed that the wooden or metal forms be replaced by precast concrete liner panels which will be manufactured or fabricated at the surface and left in place in the tunnel or shaft after grouting. The thickness and dimensions of the precast concrete lining panels will, of course, be dictated by the particular local conditions under which the tunnel or shaft is being constructed. The precast liner for each vertical liner section will be in a plurality of panels, usually three or more. In special cases when the precast liner has a width less than half its length, each vertical liner section may be composed of two panels. This facilitates passing liner panels through the already previously lined sections.

After each section is assembled in place, temporarily secured and set in place by filling in the void behind the cast sections, a new section can be started. The new section is produced by passing liner panels down through the previous section and assembling them. The new sections can be hung from hangers on inserts precast in the bottom edge of the previous liner panels, if desired. After blocking or temporarily securing the assembled liner panels in place, the void or gap between the bottom of the lining and the wall rock will be plugged. This may be accomplished by utilizing an inflatable donut-shaped ring which may be activated by compressed air. This would conform and fill to the irregularities of the wall rock and allow pouring of the curb ring at the bottom of the liner section. Preferably the curb ring would be poured with a fast-setting concrete as it merely serves the purpose of acting as a stop during pouring and filling of the void behind the liner section. After the curb ring has gained sufficient strength, the balance of the void behind the liner section can then be filled with concrete. The inflatable ring may then be deflated and removed when the curb ring has set sufficiently. The filler concrete, which is mixed on the surface, may be passed through a pipe, and remix kettle, if required, to fill the void between the lining and the wall rock. The pipe is inserted in an aperture or grouting door precast into the liner panels. One or more sections could be placed at a given time, if desired, depending upon the particular job requirements, size, shape and length of the shaft.

As was described, grouting may be accomplished through grout doors in each new liner section or through a grout ring at the bottom of the previous grouted section or through grout valves in the lining panel.

To insure a good bond between the liner panels and the grout, the surface of the liner panels facing the shaft wall could be cast with an irregular surface or embedments may be placed in the lining which protrude into the grout area, providing a gripping surface. Pipe hangers or other shaft fittings may be cast in place in the liner panels, if desired. Water rings also can be cast into selected liner panel sections.

Joints or connections between the adjacent liner sections, both vertically and horizontally, and between respective liner panels in each liner section can be provided by casting a joint into the edges of the liner panels, such as a modified tongue-in-groove so that the fit of each liner panel may be checked on the surface before placement in the shaft or tunnel. If the particular environment is such that ground water is a problem, packing may be introduced into the tongue-in-groove area, if so desired. Each new liner section may be put into place from a special platform positioned in the shaft or may be assembled together at the bottom of the shaft and hoisted into place up against the previous liner section. The hangers precast at the bottom edge of the liner panels for connecting the new section to the previous section can be fitted with bolts, or other quick-tightening mechanisms to effect a tight closure. The hangers can later be used for shaft fittings or cut away if not found useful.

The use of precast liner panels fitted against the walls of the shaft interlocking with one another can be adapted for use in either square, rectangular, oblong, or any other shape and combination shapes for shafts. Use of the precast liner panels for lining shafts effectively saves time and money by permitting quick and easy placement and setting of liner sections allowing more time for the actual construction or boring of the shaft.

Thus, the principal object of the present invention is to provide a method and system for quickly and efficiently lining shafts with precast liner panels fitted and set into place in the shaft.

Other objects, advantages and novel features of the invention will become apparent from the following detailed description and the accompanying drawings, wherein like reference numbers identify like parts throughout.

BRIEF DESCRIPTION OF THE DRAWINGS

FIG. 1 illustrates a precast liner panel for a circular shaft.

FIG. 2 is a cross-sectional view of a partial shaft.

FIG. 3 illustrates the method of placement of the precast liner panels.

FIG. 4 illustrates a mining shaft lined with the precast liner panels of the present invention.

FIG. 5 is a sectional view taken at 5—5 of FIG. 4.

FIG. 6 illustrates the placement of adjacent liner panels to form liner sections.

FIG. 7 illustrates the method of utilizing the liner panels and of the present invention for inclined rather than vertical shafts.

FIG. 8 is a sectional view taken at 8—8 of FIG. 7.

DETAILED DESCRIPTION OF THE PREFERRED EMBODIMENT

Referring to FIG. 1, there is illustrated a precast liner panel 10 for implementing the method of the present invention. The precast panels are usually cast as a partial section of the periphery of a shaft, whether or not the shaft is round, square, rectangular, etc. In the panel illustrated in FIG. 1, of course, the panel is shown as the partial circular section. In order to be able to pass the panels down through an already prelined section, the maximum cross-sectional dimension of each precast panel must be less than the maximum cross-sectional dimension of a lined shaft. Thus, for a circular shaft, in most cases three or more liner panels would be needed to line a shaft. The panels are provided with hangers 12 precast in the bottom edge for securing or hanging adjacent liner sections which will be described in greater detail hereinafter. A grouting door or slot 14 may be provided in each liner panel, permitting filling of the void after placement of the panels. Grooves 16, as well as hangers, shaft fittings, guide hangers, etc. (not shown) may be precast into the liner panels, if desired.

The placement of the precast liner panels for lining a shaft is illustrated in FIGS. 2 through 6. In FIG. 2 a shaft 18 may be drilled, bored, or constructed in any manner in the ground 20, which may be lined with the precast liner panels as each increment of the shaft 18 is drilled. In FIG. 3, the shaft 18 is shown completely sunk with the precast liner panels lowered and assembled at the bottom of the shaft and then lifted into place along with a platform 22. The liner panels after assembly are lifted by a crane 24 to the section of the shaft to be lined and then set by filling with concrete from a mixer 26.

The setting of an individual liner section is illustrated in FIG. 6. A new liner section 28 is positioned below a previously lined section 30 and assembled on the platform 22 or assembled at the bottom of the shaft as illustrated in FIG. 3, and then lifted into place. Individual liner panels are formed with a modified tongue-in-groove section 32, as illustrated in FIG. 5. The individual liner panels 10 are lowered into the shaft, assembled with their tongue-in-groove joints 32 engaging and then the assembled liner section lifted up until it abuts the previous liner section. In this case the liner section 28 would be lifted up to abut liner section 30. As was described previously, the liner sections can be joined by hangers 12 bolted together to tightly secure subsequent liner sections with previous liner sections.

At this time an inflatable donut-shaped ring is positioned beneath the bottom edge of the section being lined and a curb ring 36 poured. The curb ring preferably is poured from the fast-setting concrete and seals the gap between the bottom edge of the liner section and the shaft wall 38. The inflatable ring 34 is advantageous because it can conform to the irregular surface of the shaft wall, providing a good seal for pouring curb ring 36. After the curb ring is set, the void 40 between the liner section 28 and the shaft wall 38 is filled with concrete or grouting by a pipe 42 passed down through the shaft and extending through the liner section via the grouting door or slot 14 in the liner panel. Void 40 is then completely filled with concrete 41 and allowed to set, securely positioning the liner section 28 in the shaft. If desired, the external surface 44, shown more clearly in FIG. 1, can be made very uneven to provide a good bond between the grouting and the shaft wall 38, or even be provided with protrusions (not shown) to increase the bonding.

As can be seen by referring to FIG. 4, the shaft can be sunk and a new liner section positioned below the previously lined section before additional drilling or sinking of the shaft proceeds. In this manner the shaft liner section is completely lined as it is sunk, preventing and minimizing cave-ins or problems in sinking the shaft. The lining panels are provided with seals or packing at the modified tongue-in-groove joints 32, if ground water is a problem . The concrete filling the void 40 behind the liner panels 10 creates a pressure, forcing the panels into engagement securely setting each liner section in the shaft.

The method and system of the present invention is equally adaptable to vertical or inclined shafts, as illustrated in FIG. 8. The respective liner panel sections are positioned and assembled in the shaft as before and the curb ring poured at the bottom of the liner section, between the shaft wall and the liner. Grouting or concrete may then be poured through concrete doors or other suitable means, precast into the liner panels to set the liner section in place. Thus, each liner section is securely positioned beneath the previous liner section in a fast, efficient and inexpensive manner, as compared with the use of forms of the previous methods.

Guide rails 46 may be provided in an inclined shaft for the movement and control of platform 22.

Obviously, many modifications and variations of the present invention are possible in light of the above teachings. It is therefore to be understood that the full scope of the invention is not limited to the details described herein and may be practiced otherwise than as specifically described.

What is claimed is:

1. A method of lining shafts such as mine shafts or the like, comprising:
   - precasting a plurality of liner panels;
   - placing said precast panels in said shaft;
   - assembling said precast panels to form a liner section of predetermined length;
   - temporarily securing said panels in place;
   - plugging the gap between the wall of the shaft and the assembled panels at the bottom of the assembled panels; and
   - filling the void between the assembled panels and the shaft wall to set the liner section so that said liner section thus constitutes a section of an inplace fixed shaft lining.

2. The method according to claim 1 wherein subsequent liner sections are added by:
   - placing a plurality of said precast liner panels beneath the previous liner section;
   - assembling said plurality of panels into a liner section;
   - positioning said assembled panels beneath the previous liner section to form a new liner section;
   - temporarily securing said liner panel assembly;

plugging the gap between the shaft wall and the subsequent liner panel assembly; and filling the void between the subsequent liner panel assembly and the shaft wall to set the subsequent liner section.

3. The method according to claim 1 or 2 wherein the step of plugging the gap between the liner panels and the wall of the shaft comprises:

positioning an inflatable ring at the bottom of the panel assembly;

inflating said ring;

pouring a curb ring on top of said inflatable ring;

curing said curb ring; and removing said inflatable ring when said curb ring is cured.

4. A method according to claim 3 wherein said curb ring is poured with a quick-setting cement.

5. The method according to claim 1 or 2 wherein the step of filling the void comprises:

forming a door in the precast liner panels; and inserting a pipe down said shaft and through said door whereby the void may be filled with concrete.

6. The method according to claim 2 wherein the step of temporarily securing subsequent panel sections comprises hanging them from the bottom of the previous liner section.

7. The method according to claim 1 wherein panel sections are precast with interlocking joint means whereby assembly of respective sections can be checked before placement in the shaft.

8. The method according to claim 7 wherein said panel sections are precast with a modified tongue-in-groove joint.

9. A system for lining shafts, such as mining shafts and the like, comprising:

a plurality of precast liner panels;

joint means on said liner panels for assembling a plurality of said panels to form a liner section of predetermined length;

means for sealing the gap below a liner section from assembled liner panels; and means in said precast panels for filling the void behind said assembled panels between the panels and said mining shaft wall to set the shaft lining so that said liner section thus constitutes a section of an inplace fixed shaft lining.

10. The mine shaft lining system according to claim 9 wherein:

said joint means comprises a modified tongue-in-groove joint means.

11. The mine shaft lining system according to claim 10 including:

packing means in said tongue-in-groove joint for sealing said lining system from ground water.

12. The lining system according to claim 9 wherein said sealing means comprises an inflatable ring adapted to be positioned at the bottom end of the liner section for sealing said section during filling of the void behind said liner section.

13. The mine shaft lining system according to claim 9 wherein said plurality of precast panels are precast in at least two sections.

14. A method of lining vertical shafts or shafts inclined to the horizontal such as mine shafts or the like comprising:

precasting a plurality of liner panels;

placing said precast panels in said shaft;

assembling said precast panels to form a liner section of predetermined length;

providing support structure below said panels so as to temporarily secure said panels in place;

plugging the gap between the wall of the shaft and the assembled panels at the bottom of the assembled panels; and filling in the void between the assembled panels and the shaft wall to set the liner section so that said liner section thus constitutes a section of an inplace fixed shaft lining.

15. The method according to claim 14 wherein subsequent liner sections are added by:

placing a plurality of liner panels on said support structure;

lowering said support structure below the previous liner section;

assembling said plurality of panels on said support structure into a liner section;

positioning said assembled panels beneath the previous liner section to form a new liner section;

temporarily securing said liner panel assembly;

plugging the gap between the shaft wall and the subsequent liner panel assembly; and filling the void between the subsequent liner panel assembly and the shaft wall to set the subsequent liner section.

16. The method according to claim 14 or 15 wherein the step of plugging the gap between the liner panels and the wall of the shaft comprises:

placing an inflatable ring on said support structure;

positioning said inflatable ring at the bottom of the panel assembly;

inflating said ring;

pouring a curb ring on top of said inflatable ring;

curing said curb ring and removing said inflatable ring when said curb ring is cured.

17. A system for lining vertical shafts or shafts inclined to the horizontal such as mining shafts or the like, comprising:

two or more liner panels;

means on said liner panels for assembling said liner panels to form a liner section of predetermined length:

means for sealing the gap below a liner section from assembled liner panels; and means in said panels for filling the void behind said assembled panels between the panels and said mining shaft wall to set the shaft lining so that said liner panels thus constitute a section of an inplace fixed shaft lining.

* * * * *